United States Patent [19]

Claxton et al.

[11] 4,270,581

[45] Jun. 2, 1981

[54] VINEYARD TRELLIS WIRE RETENTION

[75] Inventors: Gerald L. Claxton; Darrell C. Horn, both of Fresno, Calif.

[73] Assignee: Up-Right, Inc., Berkeley, Calif.

[21] Appl. No.: 23,751

[22] Filed: Mar. 26, 1979

[51] Int. Cl.[3] ..... B21F 29/02

[52] U.S. Cl. ..... 140/57; 47/46; 256/57; 254/258

[58] Field of Search ..... 140/49, 52, 56, 57; 256/57; 254/82; 47/46; 403/392, 395

[56] References Cited

U.S. PATENT DOCUMENTS

| | | | |
|---|---|---|---|
| 531,630 | 1/1895 | Glenn | 140/49 |
| 590,462 | 9/1897 | Peck | 256/57 |
| 639,521 | 12/1899 | Carpenter | 140/57 |
| 1,175,228 | 3/1916 | Bowe | 254/82 |
| 1,971,047 | 8/1934 | Moritz | 256/57 |
| 2,209,288 | 7/1940 | Snodgrass | 254/82 |

*Primary Examiner*—Lowell A. Larson
*Attorney, Agent, or Firm*—Phillips, Moore, Weissenberger, Lempio & Majestic

[57] ABSTRACT

A wire retaining clip has a mid-portion extending across the back of a vineyard post and forwardly extending arms with helical turns on the ends thereof. The retaining clip is engaged with a tensioned, horizontal trellis wire so that the trellis wire is bent sharply rearwardly of the front edges of the post and is locked into the turns of the clip. The retaining clip prevents the trellis wire from pulling away from the front of the post, prevents movement of the post along the length of the trellis wire and utilizes the tension of the trellis wire to restrain twisting of the post. An installing tool provides for easy installation of the retaining clips.

4 Claims, 12 Drawing Figures

VINEYARD TRELLIS WIRE RETENTION

BACKGROUND OF THE INVENTION

This invention relates to trellis systems for vineyards or the like and more particularly to the attachment of horizontal trellis wires to vertical posts.

A typical vineyard arranged to be mechanically harvested will be planted so that there will be a plurality of parallel rows with spaced apart grape plants in each row. A trellis system is provided by installing a plurality of vertical posts along each row, usually a post at each plant and with an end post at each end of the row. One or more horizontal trellis wires are extended down each row anchored under tension to the end posts and attached to the intermediate posts. The vines are grown along the trellis wires which support the vines so that the grapes can be readily harvested therefrom.

The conventional manner of attaching the trellis wires to the intermediate wooden posts has been by the use of simple staples. In vineyards which are not mechanically harvested, this is a rapid, inexpensive and effective way of forming a trellis system. However, staple attachment has proven ineffective in keeping the wires attached to the posts when the vineyard is mechanically harvested, particularly when the harvester imparts a shaking action to the trellis. Such shaking often pulls the staples out of the posts, allowing the trellis wire to drop.

Another disadvantage of the staple attachment is encountered when a post is struck or a force imposed thereon in a direction along the length of the row. Since the staple attachment affords very little resistance to sliding movement of the attachment along the length of the trellis wire, such force will oftentimes push the post over and/or break it.

Attempts have been made to provide a more permanent attachment of a trellis wire to a post. For example, one manner is to form a wire loop around the trellis wire and the post and to twist the loop tightly and clamp the trellis wire against the post. This has proven to be a reasonably satisfactory expedient, although it still allows some sliding of the attachment along the length of the trellis wire. However, this manner of attachment is time consuming and, as a result, quite expensive.

Steel posts are often used, instead of wood posts, in vineyard trellis systems. Typically, the stake is notched to hold the trellis wire at a desired height above the ground and the trellis wire is held in the notch by means of a wire loop encircling the post and passing over the trellis wire. Again there is very little resistance to movement of the attachment along the length of the trellis wire and forces imposed on the post in a direction along the row can cause bending of the post and permanent deformation thereof. In addition, the post can twist about the vertical axis thereof and permanently deform when struck by the harvester since such trellis wire attachment provides no resistance to such twisting.

SUMMARY OF THE INVENTION

The present invention provides a solution to one or more of the above problems. In particular it provides a manner of attaching a trellis wire to a post which is usable with either wood or metal posts. When used with wood posts it prevents the trellis wires from being shaken from the posts and prevents movement of the post along the length of the trellis wire. When used with a metal post it prevents sliding movement of the post along the length of the trellis wire and also utilizes the tension in the trellis wire to support the post against twisting about its vertical axis.

In one aspect of the invention a trellis wire clip is provided, the clip consisting of a single piece of wire bent into a substantially U-shape, with a generally straight mid-portion and generally straight arms extending from the ends of the mid portion, the mid-portion having a length substantially equal to the width of the back of the post and the arms each having a length substantially less than the front-to-back thickness of the post, the arms each having a helical hook at the free end thereof. When installed, the hooks will receive and hold the horizontal trellis wire therein, with the trellis wire extending across the front of the post and being bent rearwardly at the front edges of the post.

A further aspect of the invention resides in the installing tool for the above clip, the installing tool having a head member engageable with the back of a post and a pair of pivotal arms extending away from the head member and having hooks thereon for engaging the trellis wire. The head member has a fulcrum surface thereon so that the head member can be rotated thereabout to pull the trellis wire rearwardly. The pivotal arms are more greatly spaced apart than are the arms of the trellis clip so that the clip can be easily installed on the trellis wire after the wire has been pulled rearwardly by the installing tool.

Other aspects of the invention will become apparent in the course of the following detailed description.

BRIEF DESCRIPTION OF THE DRAWINGS

In the drawings, forming a part of this application, and in which like parts are designated by like reference numerals throughout the same.

DESCRIPTION OF THE PREFERRED EMBODIMENT

Figure 1:
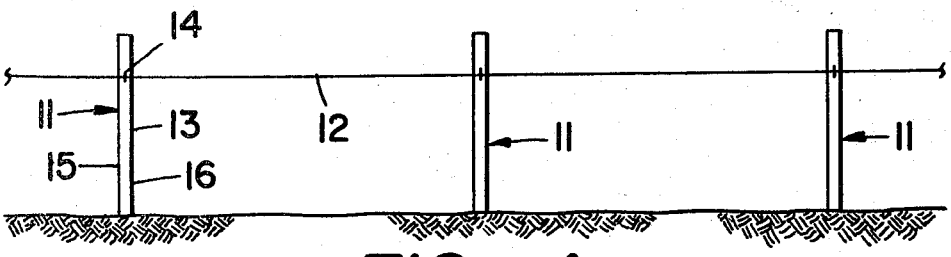
FIG. 1 is an elevational view of a portion of a row of vineyard posts having a trellis wire fixed thereto.
Figure 4:
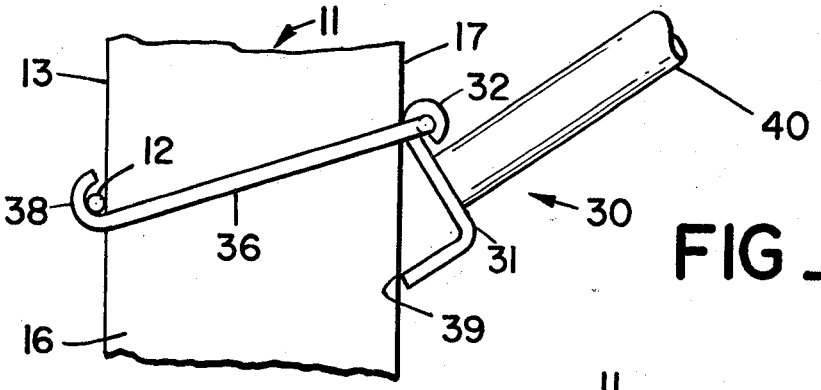
FIGS. 4 and 5 are elevational views, illustrating the use of the installing tool in attaching a trellis wire clip.

Referring now to the drawings wherein a preferred embodiment of the invention is shown, FIG. 1 illustrates a portion of a trellis system for a vineyard, such system comprising a plurality of spaced apart vertical posts 11 and a horizontal trellis wire 12 attached to the parts 13 of the posts, as by staples 14. Wooden posts are generally rectangular in horizontal cross section and have sides 15 and 16 and a back 17 (FIG. 4).

Figure 2:
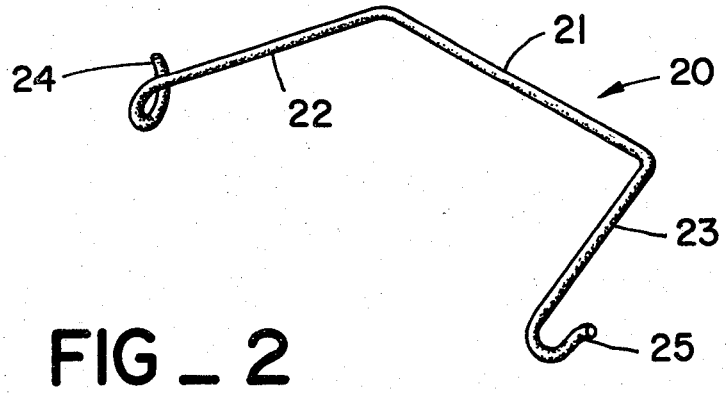
FIG. 2 is a perspective view of a trellis wire clip formed in accordance with the invention.

FIG. 2 illustrates a trellis wire retaining clip 20 formed in accordance with the present invention. As is seen, clip 20 is formed from a single piece of wire bent into a substantially U-shape with a generally straight mid-portion 21 and generally straight arms 22 and 23 extending away from the ends of the mid-portion and diverging away from each other. The mid-portion 21 has a length substantially equal to the side-to-side width of the back 17 of the post with which it is to be used, and the arms 22 and 23 each have a length substantially less than the front-to-back thickness of such post.

Arms 22 and 23 each have a helical turn, 24 and 25 respectively, at the free end thereof to form a hook eye which opens in a direction towards mid-portion 21. The helical turn 24 on arm 22 turns opposite to and extends in a direction away from the helical turn 25 on arm 23. Preferably the helical turns 24 and 25 have a common axis, i.e. the lengths of arms 22 and 23 are equal.

Figure 3:
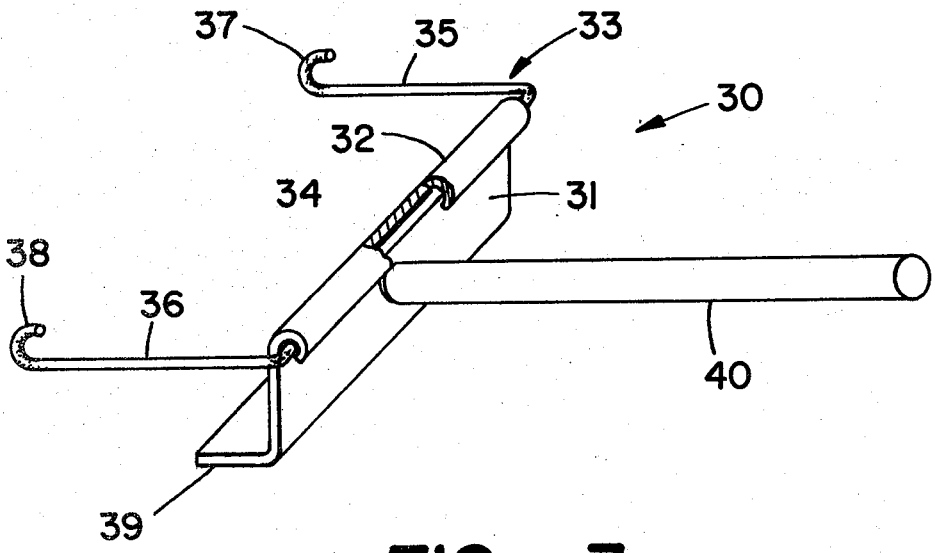
FIG. 3 is a perspective view of an installing tool in accordance with the present invention and for the installation of the trellis wire clip of FIG. 2.

FIG. 3 illustrates an installing tool 30, constructed in accordance with the invention and usable for the installation of the trellis wire retaining clip 20. Installing tool 30 includes a plate-like head member 31 having an edge turned back upon itself to form a tubular bearing member 32. A single piece of wire 33 has a mid-portion 34 disposed and supported throughout its length in bearing member 32 and arms 35 and 36 bent at generally right angles to the mid-portion 34. Hooks 37 and 38 are provided on the free ends of arms 35 and 36, respectively, for hooking engagement with the trellis wire 12. As shown in the drawings, hooks 37 and 38 extend upwardly. If desired, these hooks could be turned downwardly. As is apparent, arms 35 and 36 can pivot relative to the head member 31 and about the axis of bearing 32.

The edge of head member 31 opposite to bearing 22 is bent forwardly to provide a fulcrum surface 39 parallel to and spaced from the axis of bearing 32. An elongated handle 40 has one end thereof fixed to head member 31 and extends rearwardly therefrom, with the handle being in a plane perpendicular to the axis of bearing 32.

The arms 35 and 36 each have a length approximately equal to the front-to-rear thickness of the post 11, and are spaced apart from each other by an amount greater than the greatest distance between the arms 22 and 23 of the retainer clip 20. The distance between the axis of bearing 32 and the fulcrum surface 39 is preferably greater than the difference between the lengths of the retainer clip arms 22 and 23 and the installing tool arms, 35 and 36, so that the trellis wire 12 will be pulled back sufficiently for installation of the retainer clip 20 thereonto.

INSTALLATION

In the initial installation of the trellis system, the trellis wire 12 will already have been extended down the row of posts 11, will have been connected to end posts (not shown) at the ends of the row and will have been tensioned. The trellis wire 12 will also probably have been fastened to posts 11 by staples 14. Whether the trellis wire is so stapled or not, the retaining clip 20 is installed in the same way.

Figure 5:
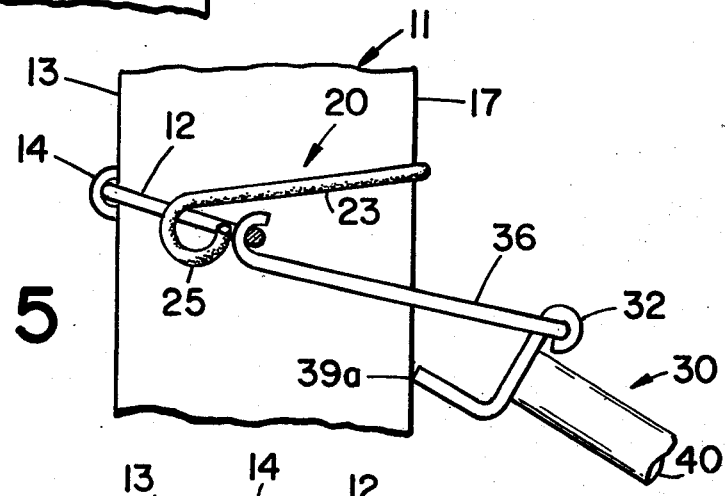
Figure 6:
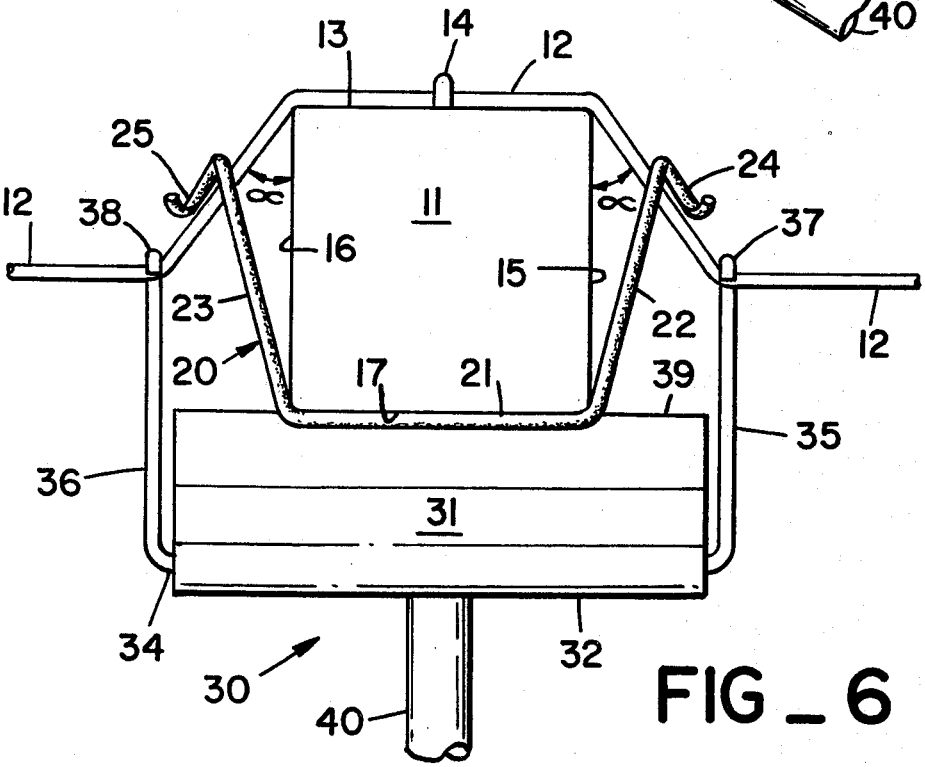
FIG. 6 is a plan view of the apparatus of FIG. 5.

The installing tool 30 is placed with its bearing member 32 against the back of the post as shown in FIG. 4 and the free ends of arms 35 and 36 are hooked onto the trellis wire 12. The fulcrum surface 32 is also against the back of the post below the level of the trellis wire 12, and the end of handle 40 is then pulled downwardly, causing head member 31 to pivot about fulcrum surface 39 so that bearing member 32 moves away from the back of the post, causing the arms 35 and 36 to pull trellis wire 12 rearwardly and downwardly. As is seen in FIG. 6, the trellis wire will bend sharply at the front edges of post 11 as the wire is pulled rearwardly. The handle 40 is pulled down enough, generally to the position shown in FIG. 5. Since the mid-portion 34 or wire 33 is long enough so that the arms 35 and 36 are spaced apart by an amount greater than the greatest distance between the retainer clip arms 22 and 23, the straight rearward pull of tool arms 35 and 36 on the trellis wire 12 will pull the trellis wire rearwardly with the distance between the tool arms 35 and 36 being maintained so that the retaining clip 20 can be put loosely into place between the tool arms 35 and 36 as shown in FIGS. 5 and 6. As is shown in FIG. 6, the trellis wire 12 will be pulled rearwardly by the installing tool 40 so that the trellis wire be at an angle $\alpha$ relative to the sides 15 and 16 of the post. The helical angles of the retainer clip turns 24 and 25 should preferably be approximately equal to $\alpha$.

As will be noted from a comparison of FIGS. 4 and 5, as handle 40 is pulled downwardly, the vertical distance from the fulcrum surface 39 to the line of pull, i.e. the position of the pivoting arms 35 and 36, decreases. This is advantageous because as the trellis wire becomes tighter, the mechanical advantage becomes greater. As a consequence, undue force is not required on the handle to pull the tautened trellis wire rearwardly.

After the retaining clip 20 has been put loosely into place, the handle 40 is allowed to be pulled up by the tension of the trellis wire. Such tension forces the trellis wire into the eyes formed by the helical turns 24 and 25 of the retaining clip so that forward movement of the trellis wire is now stopped by the retaining clip. Preferably the helical turns 24 and 25 on clip 20 should be greater than three-quarters of a turn and slightly less than a full turn so that there is some restriction to access into the turns as the trellis wire moves forwardly. The trellis wire will then engage the extreme ends of the turns and the upward and forward force of the trellis wire on the extreme ends of the turns will deform them outwardly somewhat so that the trellis wire can snap into the turns. The turns will then restore and "lock" onto the trellis wire so that it cannot be moved rearwardly back out of the turns. Handle 40 can now be pulled up to move hooks 37 and 38 forwardly so that they can disengage downwardly from the trellis wire. The installing tool can now be removed and taken to the next post.

Figure 7:
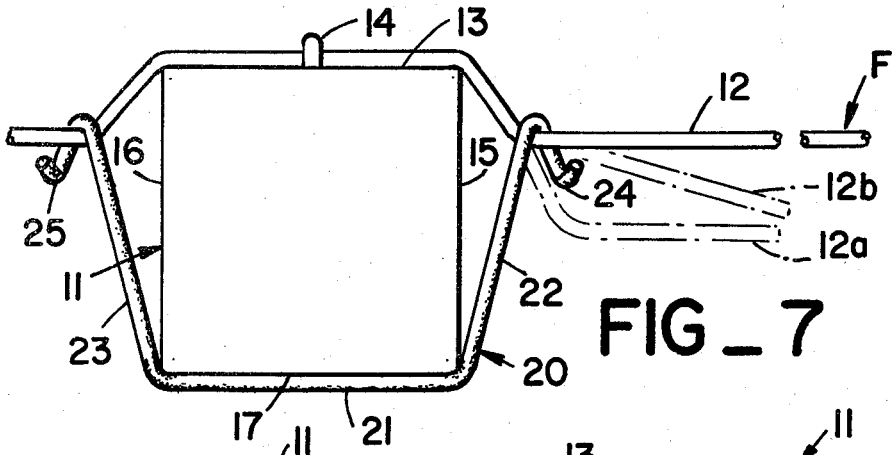
FIGS. 7, 8 and 9 are plan, front elevational and side elevational views, respectively, of a trellis wire clip installed in place of a wooden post.
Figure 8:
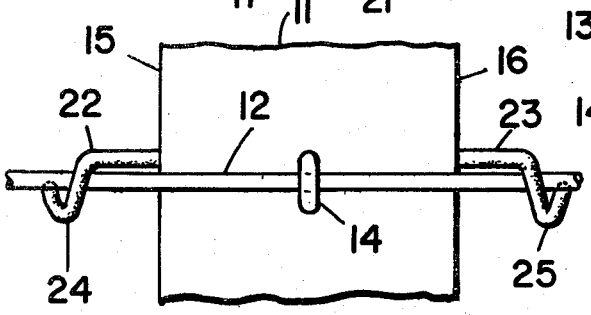
Figure 9:
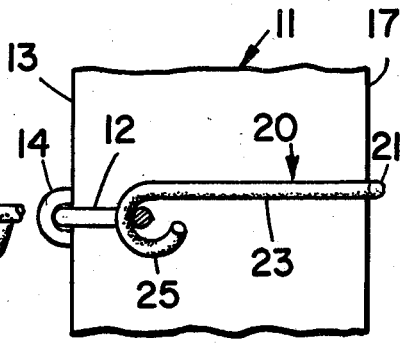

The retaining clip 20 has now been installed in place, as illustrated in FIGS. 7, 8 and 9. With reference to FIG. 7, the phantom lines 12*a* show the position of the trellis wire when pulled rearwardly by the installing tool 30. When the force exerted on the trellis wire by the installing tool is released, the tension in the trellis wire will cause the trellis wire to straighten out and bend at its point of engagement with hooks 25 and 26. If a force is exerted on the trellis wire, in a direction normal to the row and as indicated by the arrow F, the trellis wire can move to the dotted line position 12*b* but it will still engage the forward center of the helical turn 24 so that the trellis wire will remain centered in the turn and the trellis wire will also engage the upwardly extending extreme end of the helical turn so that the trellis wire will remain captured by the helical turn 24. Likewise, and as may be seen from FIG. 9, if a vertical force is imposed on trellis wire 12, either upwardly or downwardly, the trellis wire will remain captured by the helical turn which opens only rearwardly.

Since the movement of trellis wire 12 away from the front of post 11 is positively restrained by the retaining clip 20, no force will be exerted on staple 14 which will cause it to pull out of the post. The sharp bends of the trellis wire, around each front corner of the post and at each eye of the retaining clip 20, serve to anchor the post against movement along the trellis wire. As a consequence, if a force is exerted on either side 15 or 16 of the post, such force will be resisted both at ground level and at the level of the trellis wire.

Figure 10:
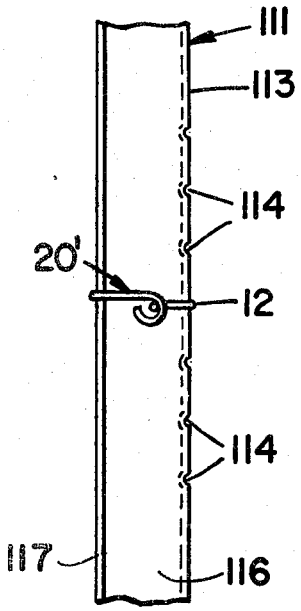
FIG. 10 is a side elevation view of the trellis wire clip of FIG. 2 in use on a metal vineyard post.
Figure 11:
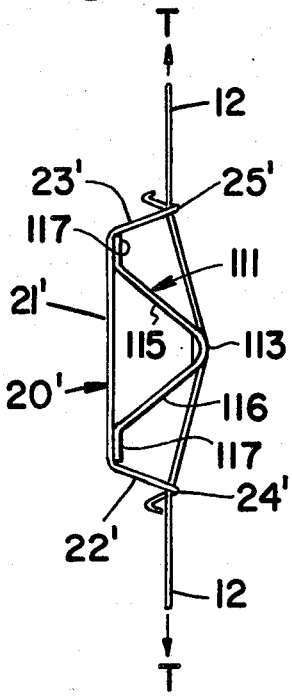
FIG. 11 is a plan view of the structure shown in FIG. 10.
Figure 12:
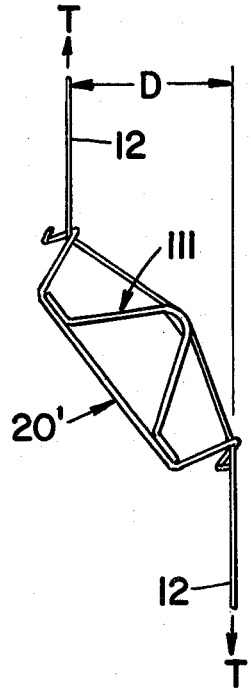
FIG. 12 is a plan view of the structure shown in FIG. 10 and with a twisted metal vineyard post.

FIGS. 10, 11 and 12 illustrate the use of retaining clip 20' to secure a horizontal trellis wire 12 secured to a vertical steel post 111. Retaining clip 20' differs from the previously described retaining clip 20 only in the particular dimensions thereof, which are related to the dimensions of the posts with which it will be used in the same way as previously described. The component parts of retaining clip 20' are designated by the same reference numerals as used previously in connection with retaining clip 20, but primed. The steel post 111 illustrated herein, is of typical configuration, and is generally V-shaped in horizontal cross-section (FIG. 11) and are provided with horizontal notches 114 at spaced vertical intervals, sides 115 and 116 diverging from edge 113 and having coplanar flanges 117 spaced from edge 113.

The purposes of definition, the surface of post 111 against which trellis wire 12 is to be secured is considered as the front of the post. Thus, in the trellis system specifically illustrated in FIGS. 10–12, the vertical edge 113 would be the front of the post, with the coplanar flanges 117 thereby constituting the back of the post.

The trellis wire 12 is disposed in a desired notch 114 and a retaining clip 20' is installed by a suitably dimensioned tool in the same way as previously described. With the clip 20' installed, the mid-portion 21' thereof will extend horizontally across the back of the post, the straight arms 22' and 23' will extend forwardly from the back of the post with the helical turns 24' and 25' functioning as hooks to hook onto the trellis wire 12. Since the arms 22' and 23' each have a length substantially less than the front-to-back thickness of the post, the tension in the trellis wire 12, represented by the force arrows T will cause the trellis wire to bend sharply around the front edge of the post and at the helical turns 24' and 25' of the retaining clip 20' so that the post is anchored against sliding movement along the length of the wire.

As mentioned previously, forces are often imposed on metal posts during harvesting such that the posts will be twisted about their vertical axes. FIGS. 11 and 12 illustrate how the present retaining clip utilizes the tension in the trellis wire to resist such deformation. With no twisting force applied to the post 111, the tension forces T in the trellis wire extending from opposite sides of the post will be in line with each other (FIG. 11). If a twisting force is applied to the post, such as to cause it to twist to the position shown in FIG. 12, the tension forces T will be offset from each other by distance D. The offset tension will thus produce a torque on the post in opposition to the applied twisting force. As is apparent from FIG. 12, the greater the twisting force on the post, the greater will be the resisting torque of the tensioned trellis wire 12.

We claim:

1. Apparatus for the retention of a horizontal trellis wire against the front of a vertical post, said post having a given front-to-back thickness and a side-to-side width at the back thereof, said apparatus comprising:

a retaining clip consisting of a single piece of wire bent into a substantially U-shape, with a generally straight mid-portion and generally straight arms extending from the ends of said mid-portion and diverging away from each other, said mid-portion having a length substantially equal to said side-to-side width of the post at the back side thereof, said arms having a length substantially less than said front-to-back thickness of said post, said arms each having a hook at the free end thereof for hooking engagement with said trellis wire, said hooks each being greater than three-quarters of a helical turn to form an eye at the free ends of the arms, said eyes being open in a direction towards said mid-portion of said retaining clip, the helical turn on one retainer clip arm being opposite to and extending in a direction away from the helical turn on the other retainer clip arm, an installing tool having a head member, a single piece of wire bent into a substantially U-shape and having a straight mid-portion and a pair of parallel arms bent at generally right angles to said mid-portion, said mid-portion being mounted on said head member for pivotal movement relative to said head member and about the axis of said mid-portion, each of said installing tool arms extending away from said head member and having a hook at the free end thereof for hooking engagement with said trellis wire, said head member having a bearing member and a fulcrum surface, said bearing member and said fulcrum surface being spaced from each other and simultaneously engageable with the back of said post, said fulcrum surface being parallel to and spaced from said axis of pivotal movement of said installing tool arms, an elongaged handle fixed at one end thereof to said head member, said handle lying in a plane perpendicular to said axis of pivotal movement of said installing tool arms, said installing tool arms each having a length approximately equal to said front-to-rear thickness of said post for enabling said arms to be hooked onto said trellis wire when said bearing surface engages said back of the post, said installing tool arms being spaced apart by an amount greater than the greatest distance between said retainer clip arms, the distance between said axis of pivotal movement of said installing tool arms and said fulcrum surface being greater than the difference between the lengths of said retainer clip and installing tool arms.

2. Apparatus as set forth in claim 1, wherein said mid-portion of said installing tool wire is supported throughout its length by said head member.

3. Apparatus for the retention of a horizontal trellis wire against the front of a vertical post having a given front-to-back thickness and a side-to-side width at the back thereof, a retaining clip consisting of a single piece of wire bent into a substantially U-shape, with a generally straight mid-portion and generally straight arms extending from the ends of said mid-portion and diverging away from each other, said mid-portion having a length substantially equal to said side-to-side width of the post at the back side thereof, said arms each having a length substantially less than said front-to-back thickness of said post, said arms each having a hook at the free end thereof for hooking engagement with said trellis wire, said hooks each being greater than three-quarters of a helical turn to form an eye at the free ends of the arms, said eyes being open in a direction towards said mid-portion of said retaining clip, the helical turn on one retainer clip arm being opposite to and extending in a direction away from the helical turn on the other retainer clip arm, said apparatus comprising:

an installing tool having a head member, a single piece of wire bent into a substantially U-shape and having a straight mid-portion and a pair of parallel arms bent at generally right angles to said mid-portion, said mid-portion being mounted on said head member for pivotal movement relative to said head member and about the axis of said mid-portion, each of said installing tool arms extending away from said head member and having a hook at the free end thereof for hooking engagement with said trellis wire, said head member having a bearing member and a fulcrum surface, said bearing member and said fulcrum surface being spaced from each other and simultaneously engageable with the back of said post, said fulcrum surface being parallel to and spaced from said axis of pivotal movement of said installing tool arms, an elongated handle fixed at one end thereof to said head member, said handle lying in a plane perpendicular to said axis of pivotal movement of said installing tool arms, said installing tool arms each having a length approximately equal to said front-to-rear thickness of said post for enabling said arms to be hooked onto said trellis wire when said bearing surface engages said back of the post, said installing tool arms being spaced apart by an amount greater than the greatest distance between said retainer clip arms, the distance between said axis of pivotal movement of said installing tool arms and said fulcrum surface being greater than the difference betwen the lengths of said retainer clip and installing tool arms.

4. Apparatus as set forth in claim 3, wherein said mid-portion of said installing tool wire is supported throughout its length by said head member.

* * * * *